US006802273B2

(12) United States Patent
Mizuno

(10) Patent No.: US 6,802,273 B2
(45) Date of Patent: Oct. 12, 2004

(54) THREAD BREAKAGE DETECTION DEVICE FOR SEWING MACHINE

(75) Inventor: Yasushi Mizuno, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 143 days.

(21) Appl. No.: 10/166,764

(22) Filed: Jun. 12, 2002

(65) Prior Publication Data

US 2003/0000439 A1 Jan. 2, 2003

(30) Foreign Application Priority Data

Jun. 15, 2001 (JP) ..... 2001-181231

(51) Int. Cl.[7] ..... D05B 69/36
(52) U.S. Cl. ..... 112/278
(58) Field of Search ..... 112/278, 273; 33/1 PT, 1 N, 708, 703; 200/61.13, 61.18

(56) References Cited

U.S. PATENT DOCUMENTS 4,196,685 A * 4/1980 Tamura ..... 112/273
5,018,465 A * 5/1991 Hager et al. ..... 112/273
5,322,028 A * 6/1994 Hashiride et al. ..... 112/278
6,341,426 B1 * 1/2002 Okumura ..... 33/1 PT

FOREIGN PATENT DOCUMENTS

JP A 7-148373 6/1995
JP A 9-327585 12/1997

* cited by examiner

*Primary Examiner*—Peter Nerbun
(74) *Attorney, Agent, or Firm*—Oliff & Berridge, PLC

(57) ABSTRACT

A stitch balancing thread tension 11 of a sewing machine 1 includes a rotary disk 17 having a surface extending perpendicular to an axial direction of a shaft 16 on which the rotary disk 17 is mounted. The thread breakage detection device includes a permanent magnet member 21 attached to the surface of the rotary disk 17, a hole element 22 that detects a magnetic field generated at the permanent magnet member 21 and outputs detection signals, and a detection unit that detects the thread breakage based on the detection signals from the hole element 22. Because the thread breakage detection device is integrally formed to the stitch balancing thread tension 11, the thread breakage detection device can be provided to the sewing machine 1 without increasing a number of components and the size of the sewing machine 1.

17 Claims, 8 Drawing Sheets

THREAD BREAKAGE DETECTION DEVICE FOR SEWING MACHINE

BACKGROUND OF THE INVENTION

1. Field of the Invention

The present invention relates to a thread breakage detection device for sewing machines, and more specifically to a thread breakage detection device including a permanent magnet member and a hole element provided to a stitch balancing thread tension having a rotary disk.

2. Related Art

There have been provided sewing machines for industrial use capable of stitching multicolor embroidery patterns. One type of such sewing machines includes a needle-bar casing that houses a plurality of needle bars each mounting a needle at its lower end. During embroidery operation, the needle-bar casing is moved right and left to select one of the needles to use. A plurality of thread spools for supplying needle threads are provided on a thread spool stand that is fixed behind the needle-bar casing. A frame, to which a plurality of thread breakage detection sensors and a plurality of stitch balancing thread tensions are attached, is formed to an upper part of the needle-bar casing. The needle threads from the thread spools are supplied to the corresponding needles via the corresponding thread breakage detection sensors and stitch balancing thread tensions.

Each thread breakage detection sensor includes, for example, a shaft that rotates in association with the supply of the needle thread, a photo-interrupter supported on the frame, and an encode disk formed with a plurality of slots. The encode disk is fixed to and integrally rotatable with the shaft, and detects thread breakage based on detection signals from the photo-interrupter.

However, the above conventional configuration requires an increased number of components because of the thread breakage detection sensor provided to the frame, whereby the manufacturing costs of the sewing machine are increased, and the overall configuration becomes complex. This problem is particularly striking in a multi-needle sewing machine for industrial use where a plurality of needles are provided since in this case a plurality of thread breakage detection sensors are required. Also, dust raised during embroidery operation often causes detection error.

SUMMARY OF THE INVENTION

It is an object of the present invention to overcome the above problems, and also to provide a thread breakage detection device that can be used in a sewing machine without increasing the number of components, the manufacturing costs, or the size of the sewing machine.

In order to achieve the above and other objects, there is provided a thread breakage detection device used in a stitch balancing thread tension having a shaft and a rotary disk having a surface extending perpendicular to an axial direction of the shaft and rotating in accordance with a supply of a thread. The thread breakage detection device including a permanent magnet member attached to the surface of the rotary disk and generating a magnetic field, a hole element that detects the magnetic field generated in the permanent magnet member and outputs a detection signal based on the detected magnetic field, and a detection unit that detects a thread breakage of the thread based on the detection signal.

There is also provided a stitch balancing thread tension including a stationary member, a shaft relatively rotatable with respect to the stationary member, a rotary disk that applies a tension to a thread, the rotary disk being mounted on the shaft and having a surface that extends perpendicular to an axial direction of the shaft, a permanent magnet member attached to the surface of the rotary disk, and a hole element mounted on the stationary member, the hole element detecting a magnetic field generated in the permanent magnet member.

Further, there is provided a sewing machine including a stationary member, a shaft, a rotary disk, a permanent magnet member, a hole element, a measuring unit, a counting unit, and a detector. The shaft is relatively rotatable with respect to the stationary member. The rotary disk applies a tension to a thread. The rotary disk is mounted on the shaft and has a surface that extends perpendicular to an axial direction of the shaft. The permanent magnet member is attached to the surface of the rotary disk. The hole element mounted on the stationary member, detects a magnetic field generated in the permanent magnet member, and outputs a detection signal based on the detected magnetic field. The measuring unit measures a time duration during an embroidery operation. The counting unit counts a number of times the detection signal changes. The detector detects a thread breakage of the thread when the counting unit does not count a predetermined number within a predetermined time duration during the embroidery operation.

BRIEF DESCRIPTION OF THE DRAWINGS

In the drawings:

FIG. 5(*b*) is a simplified side view of the permanent magnet member;

FIG. 6(*b*) is an explanatory view of a detection signal output when a bobbin thread is broken;

FIG. 9(*b*) is a simplified side view of the permanent magnet member of FIG. 9(*b*);

FIG. 10(*b*) is a graph showing an actual expending amount when a needle thread is broken during operations; and FIG. 10(*c*) shows irregular data appearing in a data pattern, when a bobbin thread is broken, indicating an actual expending amount of the needle thread.

PREFERRED EMBODIMENT OF THE PRESENT INVENTION

Next, a preferred embodiment of the present invention will be described while referring to the attached drawings. In the present embodiment, a thread breakage detecting unit of the present invention is applied to a multi-needle sewing machine having a plurality of needles capable of stitching multicolor embroidery patterns. First, an overall configuration of the multi-needle sewing machine will be described.

Figure 1:
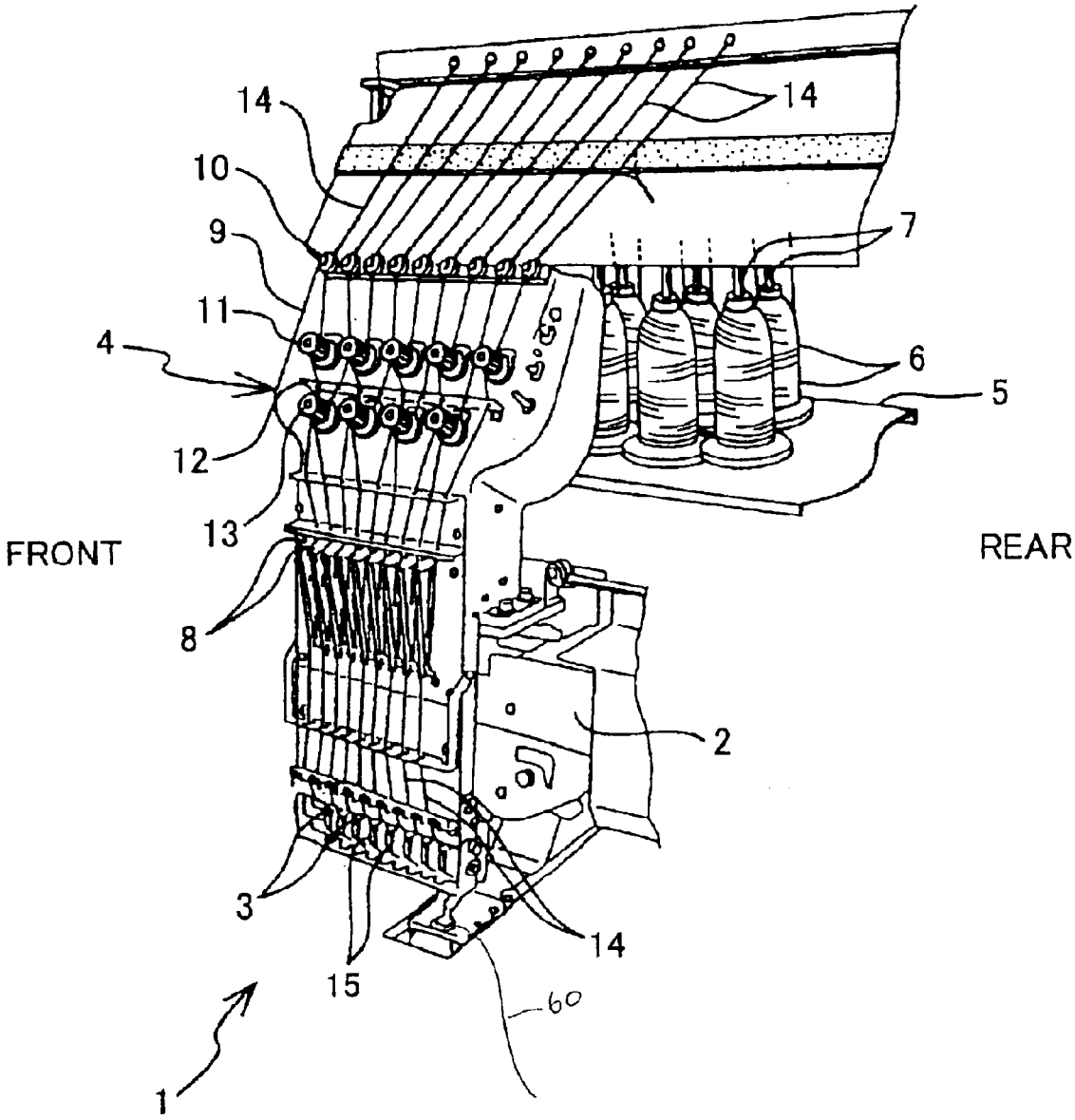
FIG. 1 is a perspective partial view of a sewing machine including a thread breakage detection unit according to an embodiment of the present invention.

As shown in FIG. 1, a multi-needle sewing machine 1 includes an arm 2, a needle-bar casing 4 provided on a front end of the arm 2, and a thread-spool stand 5 fixedly provided to an upper part of the arm 2 behind the needle-bar casing 4. The needle-bar casing 4 is freely movable right and left and houses a plurality of needle bars 3 arranged in a line from the right to the left. The thread-spool stand 5 is provided with a plurality of arm spool pins 7 each mounting a thread spool 6.

The plurality of needle bars 3 and a plurality of thread take-up levers 8 are vertically movably provided to the lower part of the needle-bar casing 4. A support frame 9 is formed to the upper part of the needle-bar casing 4. Provided on the front surface of the frame 9 are a plurality of tension generators 10 aligned horizontally, a plurality of stitch balancing thread tensions 11 aligned horizontally, a bobbin winder tension member 12, and a plurality of stitch balancing thread tensions 13 aligned horizontally, arranged in this order from the above to the bottom. Needle threads 14 from the corresponding thread spools 6 are led to corresponding needles 15 via the tension generators 10, the stitch balancing thread tensions 11, the stitch balancing thread tensions 13, the bobbin winder tension member 12, the thread take-up levers 8, and the like. A bobbin thread 60 is extending from a bobbin (not shown).

Figure 2:
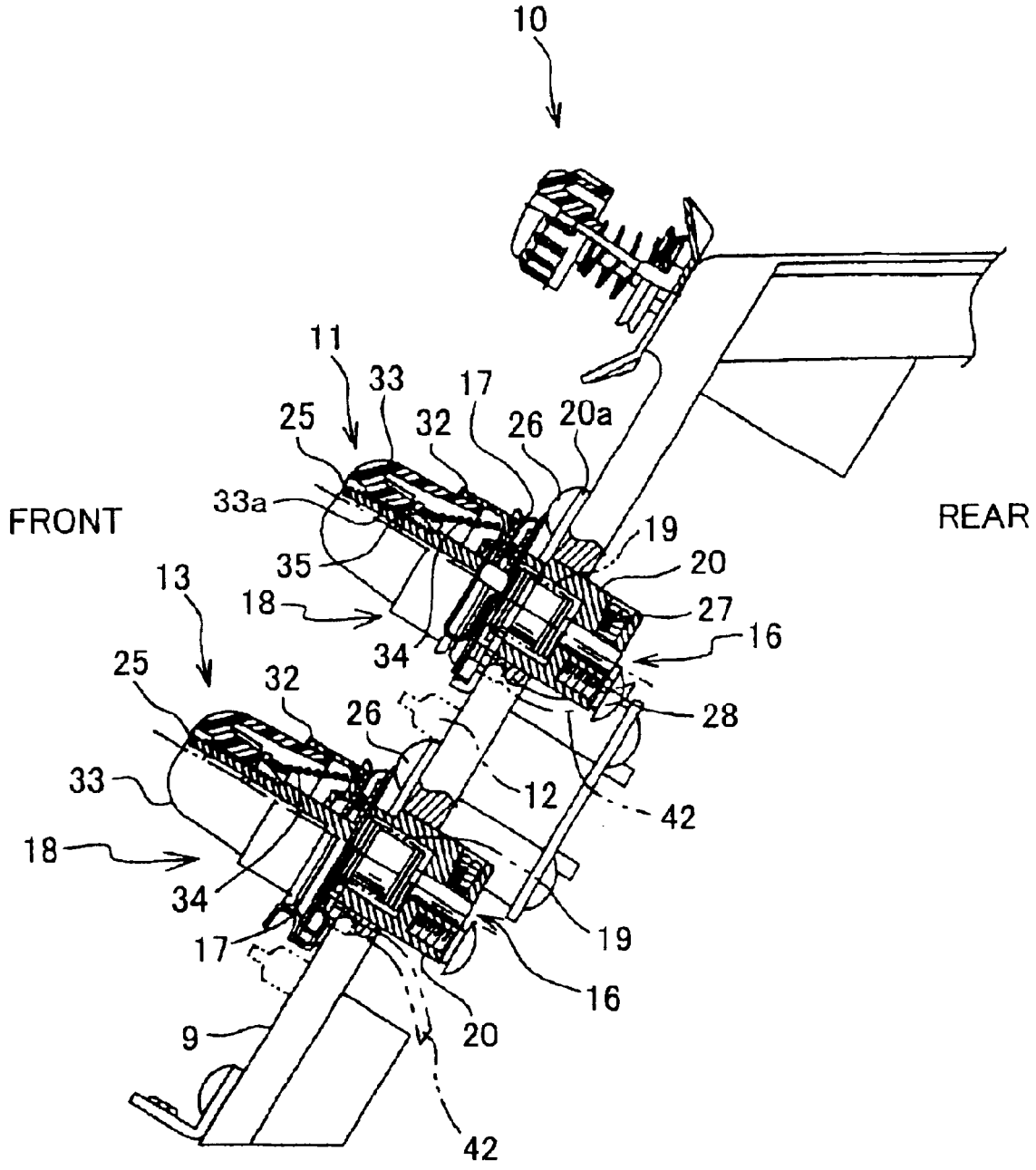
FIG. 2 is a partially cross-sectional view of the sewing machine of FIG. 1.
Figure 3:
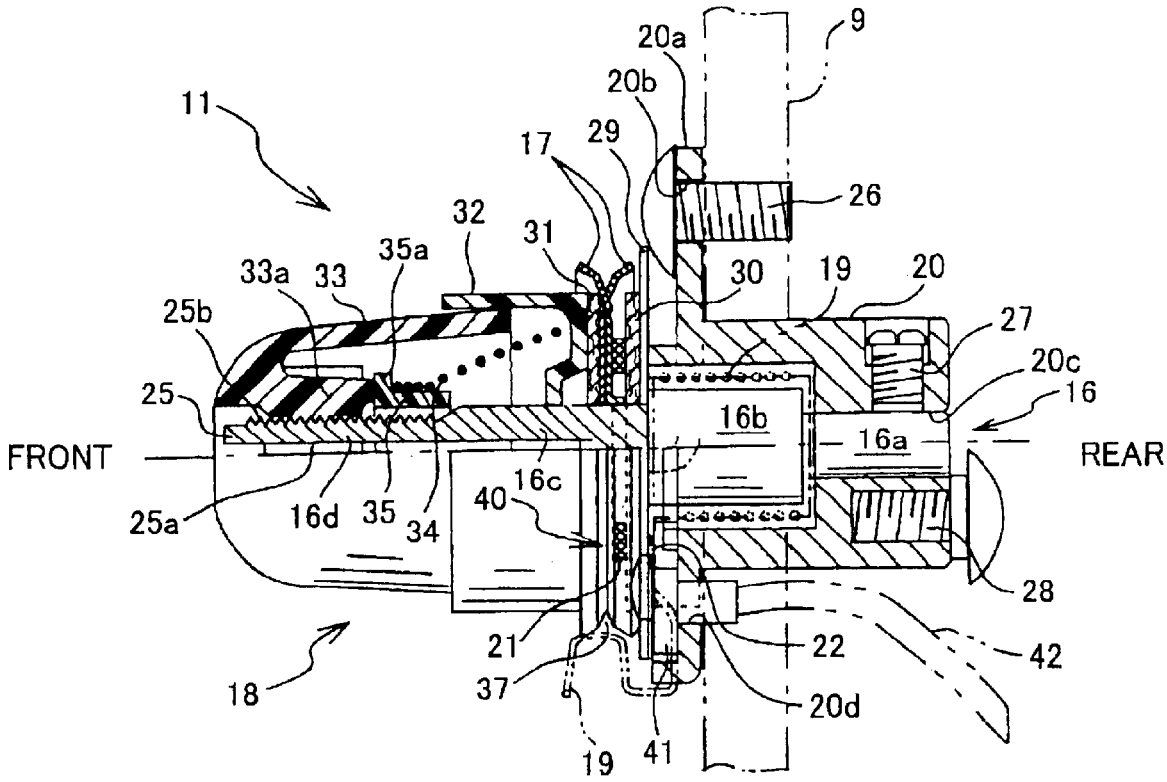
FIG. 3 is an enlarged view of a stitch balancing thread tension of the sewing machine integrally formed with the thread breakage detection unit.
Figure 4:
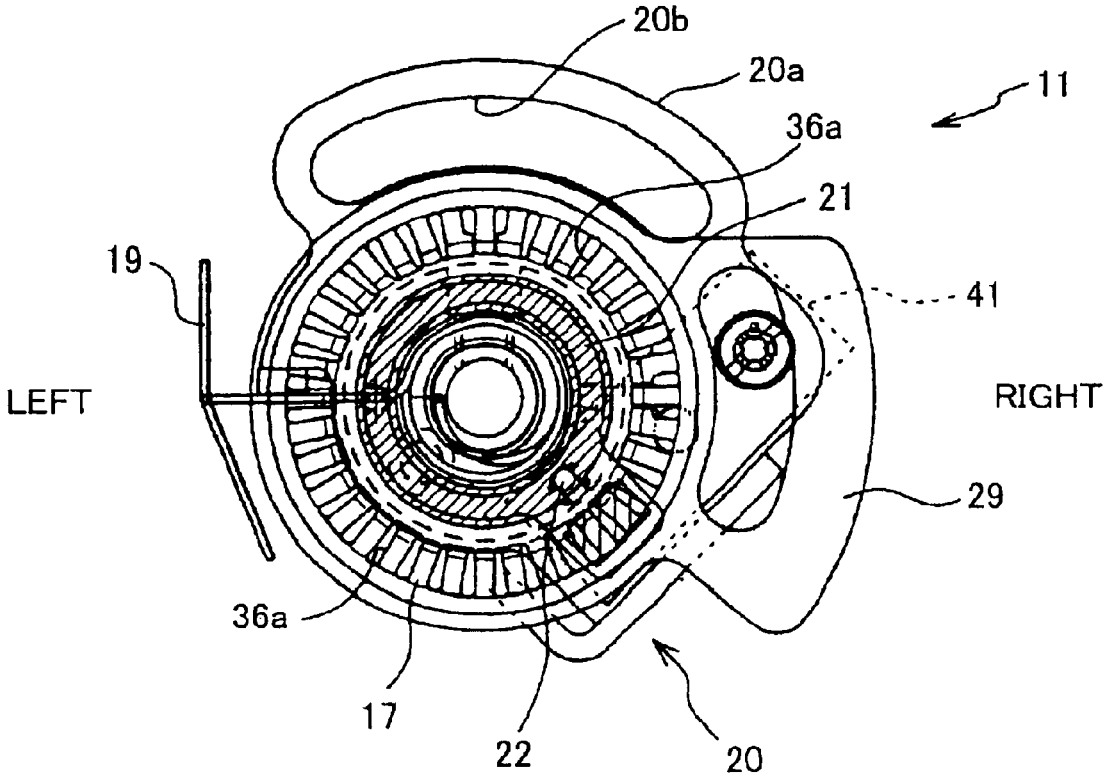
FIG. 4 is a front view of the stitch balancing thread tension integrally formed with the thread breakage detection unit.

Next, description will be provided for the stitch balancing thread tensions 11 and 13. Because the stitch balancing thread tensions 13 have the same configuration as the stitch balancing thread tensions 11, only the stitch balancing thread tensions 11 will be described. As shown in FIG. 2 and 3, each stitch balancing thread tension 11 includes a shaft 16, a rotary disk 17, a regulation unit 18, a thread take-up spring 19, a body 20, and the like. The body 20 is made of metal and, as shown in FIG. 4, has a flange 20*a* formed with a hole 20*b* in an elongated round shape. As shown in FIG. 3, the body 20 is fixed to the frame 9 by a screw 26 inserted through the hole 20*b*. In this configuration, the relative position of the stitch balancing thread tension 11 to the frame 9 can be controlled by moving the body 20 with respect to the screw 26.

The shaft 16 is formed of a small-diameter portion 16*a*, a large-diameter portion 16*b*, a medium-diameter portion 16*c*, and a small-diameter portion 16*d*, arranged in this order from the rear side to have a stepped configuration. The small-diameter portion 16*a* and the large-diameter portion 16*b* are housed inside the body 20 with the thread take-up spring 19 mounted on the outer periphery of the large diameter portion 16*b*. The small-diameter portion 16*a* is tightly engaged to an engaging hole 20*c* formed in the rear portion of the body 20, and is fixed to the body 20 by a screw 27. A ground locking screw 28 is also provided to the body 20.

The shaft 16 is formed with an expanding slot 25*a* extending from a tip end of the medium-diameter portion 16*c* across the entire length of the small-diameter portion 16*d* in its axial direction. A thin-plate member 29, a circular felt member 30, the rotary disk 17, and a circular felt member 31 are mounted on an outer periphery of a base end of the medium-diameter portion 16*c*. The thin-plate member 29, the circular felt member 30, the rotary disk 17, and the circular felt member 31 are integrally rotatable. Here, a user can, after loosing the screw 27, rotate the shaft 16 around its axis using a flat head driver inserted into the expanding slot 25*a*. In this manner, the user can adjust the urging force of the thread take-up spring 19.

The regulation unit 18 is for regulating the rotation resistance of the rotary disk 17 and includes a tension disk 32, a turning dial 33, a helical compression spring 34, and a circular spring bearing 35. The tension disk 32 is formed of a compound resin to a sleeve shape with a front side open, and is mounted on the periphery of a rear half portion of the medium-diameter portion 16*c* such that the tension disk 32 is movable in the axial direction of the shaft 16. A rear side of the tension disk 32 contacts and applies relatively small pressing force to the circular felt members 31, 30, which are for applying the rotation resistance to the rotary disk 17. The turning dial 33 is formed of a compound resin to a tapered sleeve shape with its rear side open, which is engaged inside the tension disk 32 Inside a front half portion of the turning dial 33 is integrally formed with a sleeve portion 33*a* whose inner periphery defines a female screw that engages a male screw 25*b* formed to an outer periphery of the small-diameter portion 16*d*.

The spring bearing 35 is housed inside the turning dial 33 and mounted on the small-diameter portion 16*d* so as to be movable in the axial direction. The helical compression spring 34 provided between a flange 35*a* formed to the, front end of the spring bearing 35 and the tension disk 32 urges the flange 35*a* to contact the sleeve portion 33*a* and urges the tension disk 32 to press the rotary disk 17. In this configuration, when a user rotates the turning dial 33 with his fingers, the spring bearing 35 moves forward and backward in the axial direction, thereby changing the urging force of the helical compression spring 34 applied onto the tension disk 32. In this manner, the rotation resistance of the rotary disk 17 is adjusted.

Here, the rotary disk 17 is formed of a pair of thin metal disks engaged each other back to back to define on its outer periphery a thread guide groove 37 having a V-shaped cross section. The needle thread 14 is wound around the thread guide groove 37 to make a single complete circle. As shown in FIG. 4, the rotary disk 17 is formed of a plurality of through holes 36*a* aligned equidistance from each other along the outer periphery for preventing slippage between the rotary disk 17 and the needle thread 14 wound therearound. In this configuration, the rotary disk 17 rotates as the needle thread 14 is supplied to the needles 15 during embroidery operations.

Figure 5A:
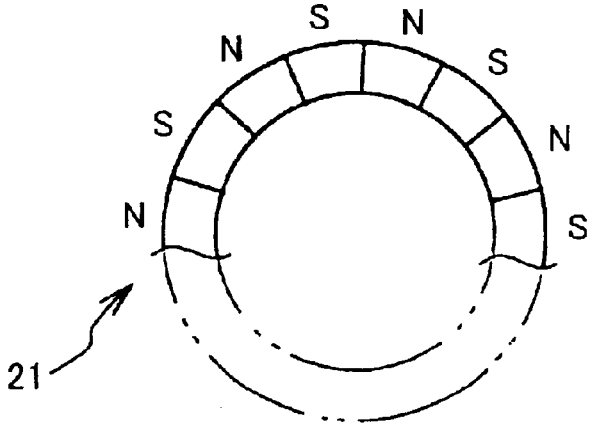
FIG. 5(*a*) is a front view of a permanent magnet member of the thread breakage detection unit.
Figure 5B:
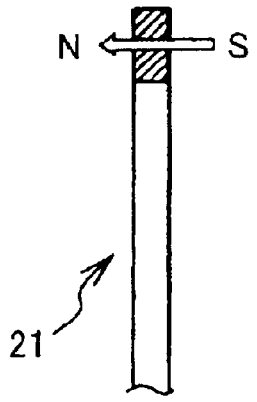
Figure 7:
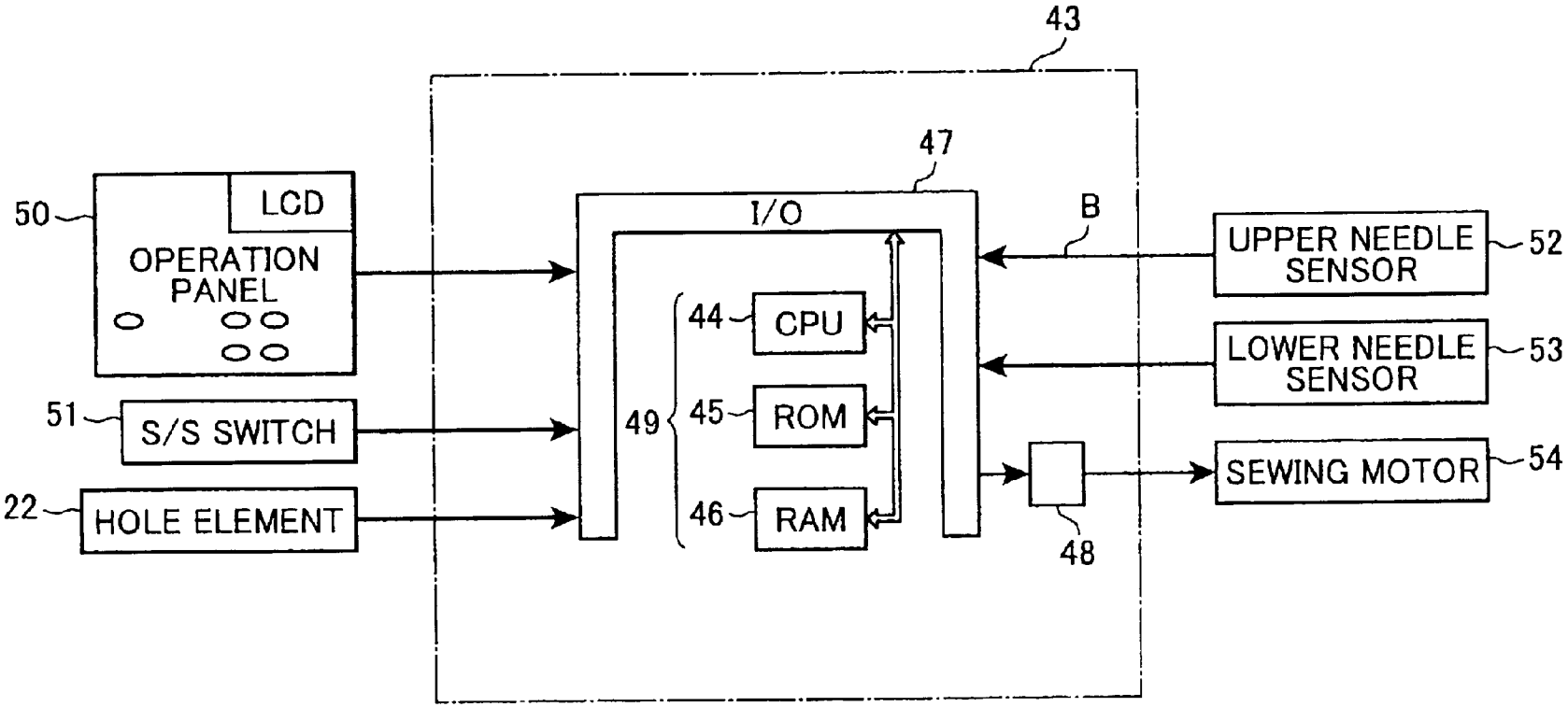
FIG. 7 is a block diagram showing a control mechanism of the sewing machine.

The sewing machine 1 also includes a thread breakage detection unit 40 shown in FIG. 3. The thread breakage detection unit 40 detects thread breakage of the needle thread 14 and the bobbin thread 60 and includes a permanent magnet member 21, a hole element 22, and a control device 43 (FIG. 7). The permanent magnet member 21 is attached to the rear surface of the rotary disk 17 by sintering (pore into a casing and sinter) so that the permanent magnet member 21 rotates integrally with the rotary disk 17 when the needle thread 14 is supplied. FIG. 5(*a*) shows a rear surface of the hole element 22 opposite to a front surface fixed to the rotary disk 17. The permanent magnet member 21 is formed of sintered metal to have a ring shape with a thickness of 2 mm to 3 mm and a diameter that is approximately the half of the diameter of the rotary disk 17. As shown in FIG. 5, a plurality of north poles and a plurality of south poles are arranged in the rear surface of the permanent magnet 21 in alternation.

As shown in FIG. 3, the hole element 22 is mounted on a rectangular-shaped substrate 41 that is attached to the front surface of the flange 20*a* of the body 20 by an adhesive. The hole element 22 is positioned close to the permanent magnet member 21 and facing one of the north poles and the south poles of the permanent magnet member 21. The flange 20*a* is formed with a through hole 20*d* through which a lead wire 42 extends from the hole element 22 to the control device 43.

As shown in FIG. 5(*b*), the magnetic field generated at the permanent magnet member 21 has a direction parallel to the thickness direction of the permanent magnet 21, i.e., to the axial direction of the stitch balancing thread tension 11 and selectively reaches to the hole element 22. As the rotary disk 17 rotates, a pole that confronts the hole element 22 switches from a north pole to a south pole and vice versa, so that the direction of the magnetic field projected to the hole element 22 is reversed in short period of time. As a result, a sinusoidal wave signal is generated in the hole element 22 and output as a detection signal to the control device 43 via the lead wire 42. The CPU 44 shapes this sinusoidal wave signal and then converts into a rectangular pulse signal having a value of "0" and "1" as shown in FIG. 6, wherein the pulse signal of "0" indicates the magnetic field with a forward direction, for example, and the pulse signal of "1" indicates the magnetic field with a reversing direction.

When the needle thread 14 is broken during the operation, supply of the needle thread 14 from the thread spool 6 completely stops, and therefore the rotary disk 17 stops rotating. Because the permanent magnet member 21 stops rotating also, the direction of the magnetic field projected to the hole element 22 stays constant. The resultant pulse signal becomes either a signal a or a signal b shown in FIG. 6(*a*) depending on the direction at this time. Accordingly, it is possible for the CPU 44 to detect the occurrence of the thread breakage based on the detection signal from the hole element 22.

Figure 6A:
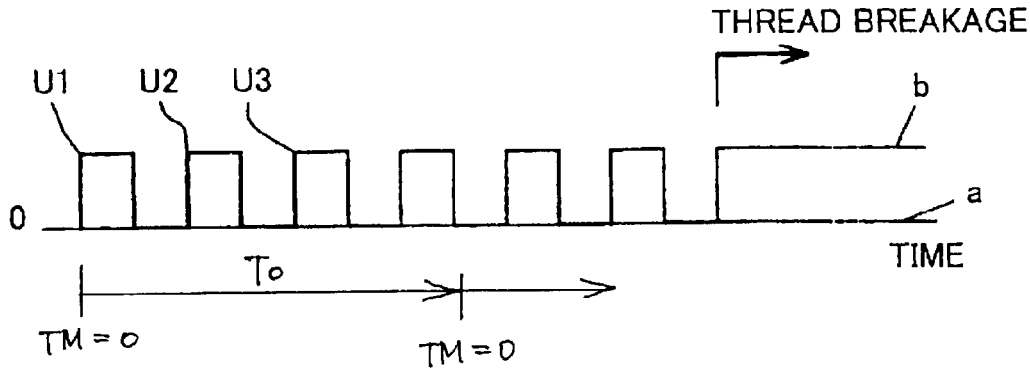
FIG. 6(*a*) is an explanatory view of a detection signal output when a needle thread is broken.
Figure 6B:
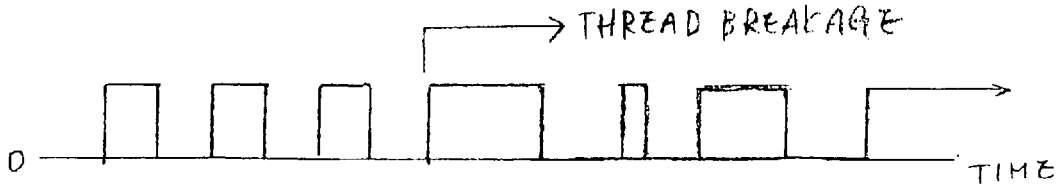

On the other hand, when the bobbin thread 60 is broken during the operation, a resultant pulse signal becomes as shown in FIG. 6(*b*). This is because the needle thread 14 and the bobbin thread 60 become out of balance, disrupting a stable rotation of the rotary disk 17. The rotary disk 17 may rotate faster and slower than a regular speed to increase and decrease the needle-thread supply speed. In this case also, the CPU 44 can detect the occurrence of the thread breakage based on the detection signal from the hole element 22.

Next, a control mechanism will be described while referring to FIG. 7. The control device 43 includes a microcomputer 49, an I/O interface 47, a driver 48 connected one another via a bus B. Although not shown in the drawings, the I/O interface 47 includes the above-mentioned waveform shaping circuit that shapes a sinusoidal wave signal from the hole element 22 and the above-mentioned converter that converts the signal that has been shaped by the waveform shaping circuit into a rectangular pulse signal having the value of "0" and "1" (FIG. 6).

Connected to the I/O interface 47 are an operation panel 50, a start/stop (S/S) switch 51, the hole element 22, an upper needle sensor 52 for detecting an upper needle position of the needle 15, a lower needle sensor 53 for detecting a lower needle position of the needle 15, a sewing motor 54 for rotating a main shaft (not shown) of the sewing machine 1, and the like. The sewing motor 54 is driven by the driver 48.

The microcomputer 49 includes a central processing unit (CPU) 44, a read only memory (ROM) 45, and a random access memory (RAM) 46. The ROM 45 stores a thread breakage detection control program (described later) and various control programs for processing the detection signal from the hole element 22 and detecting the breakage of the thread 14, 60. The RAM 46 is provided with work memories, such as various flags, buffers, registers, and counters.

Figure 8:
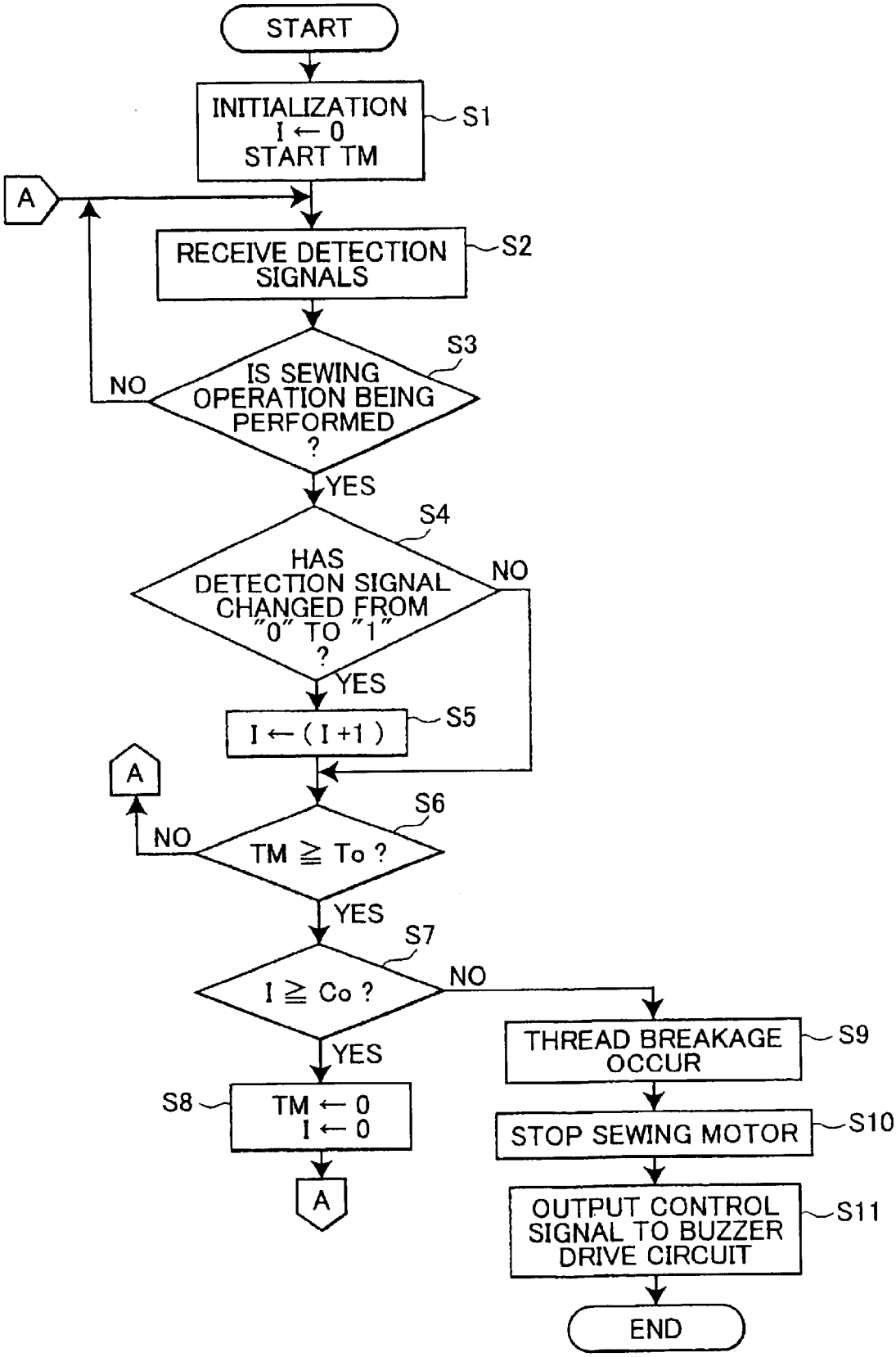
FIG. 8 is a flowchart representing a thread breakage detection process.

Next, a control process of the thread breakage detection executed by the control device 43 will be described while referring to a flowchart of FIG. 8. This process is started when the S/S switch 51 is turned ON. When the process starts, first in S1, a counter I, which is for counting the detection signal from the hole element 22, is initialized to zero, and a timer TM is started. Both the counter I and the timer TM are stored in the RAM 46. Next in S2, detection signals from the hole element 22, the upper needle sensor 52, and the lower needle sensor 53 are detected, and it is determined in S3 whether or not the embroidery operation is currently performed. If not (S3:NO), then the process returns to S2. If so (S3:YES), then the process proceeds to S4 where it is determined whether or not the detection signal from the hole element 22 shown in FIG. 6 has changed from "0" to "1". If so (S4:YES), then in S5, the counter I is incremented by one, and process proceeds to S6. If not (S4:NO), the process directly proceeds to S6.

In S6, it is determined whether or not the timer TM has measured a predetermined time duration To, for example, 1 minute. If not (S6:NO), then the process returns to S2. On the other hand, if so (S6:YES), then in S7, it is determined whether or not the counter I has counted a predetermined count value Co. If so (S7:YES), this means that the thread breakage has not occurred. The counter I is reset to zero and the timer TM restarts in S8 (FIG. 6), and the process returns to S2. Here, the count value Co is set in accordance with the diameter of the rotary disk 17, i.e., of the hole element 22, the number of the poles (the north poles and the south poles (dividing number)), and an expending rate of the needle thread 14 during ordinary embroidery operation, which is in proportion to the rotation number of the sewing motor 54. The count value Co can be set sufficiently small value, such as 10 or 50.

If a negative determination is result in S7 (S7:NO), this means that the rotary disk 17 has stopped rotating in the middle of the embroidery operation, indicating that the thread breakage has occurred. The thread breakage is detected in S9, and the sewing motor 54 stops driving the main shaft in S10 so as to stop the embroidery operation. Then, in S11, a control signal is output to a buzzer driving circuit (not shown) to notify a user the thread breakage.

As described above, the thread breakage is detected based on the detection signal from the hole element 22 that is generated based on the magnetic field reaching to the hole element 22 from the permanent magnet member 21. Because the permanent magnet member 21 and the hole element 22 are integrally provided in the stitch balancing thread tension 11, there is no need to provide a thread-breakage detection device as a separate component from the stitch balancing thread tension 11, 13. This realizes a small-sized inexpensive thread-breakage detection unit, and thus reduces the overall size and production costs of the sewing machine 1. This is particularly striking in the multi-needle sewing machine 1 for industrial use that includes the plurality of needles 15, that is, the plurality of stitch balancing thread tensions 11, 13 on the single frame 9. Because there is no need to provide a plurality of thread-breakage detection units separate from the stitch balancing thread tensions 11, 13, the number of components is reduced, so that small-sized frame 9 and thus the small-sized sewing machine 1 can be provided.

Because the permanent magnet 21 is attached to the rotary disk 17 which is a component of the existing tension unit 11, 13, an available area to attach the permanent magnet 21 is limited. This requires designing the permanent magnet 21 in accordance with the limited area. However, it is easy to form the permanent magnet member 21 of a sintered metal into a desired shape. Here, it is conceivable to attach the conventional detection sensor including the photo interrupter and the encode disk to the existing tension unit. However, in this case, the configuration of the electric circuit becomes complex because of space limitations.

Also, the arrangement of the north poles and the south poles is easily changed in the above embodiment. For example, increasing the number of the north poles and the south poles increases detection accuracy.

Because the rotary disk 17 rotates relative to the body 20 whose positioning is adjustable with respect to the frame 9, it is possible to adjust the relative position of the tension units 11 to the frame 9 without changing the relative positional relationship between the permanent magnet member 21 and the hole element 22.

Moreover, erroneous detection due to dust raised during the embroidery operation does not occur in the detection device using the permanent magnet 21 and the hole element 22. This contrast to the above-described conventional detection device that uses the photo interrupter and the encode disk.

Figure 10A:
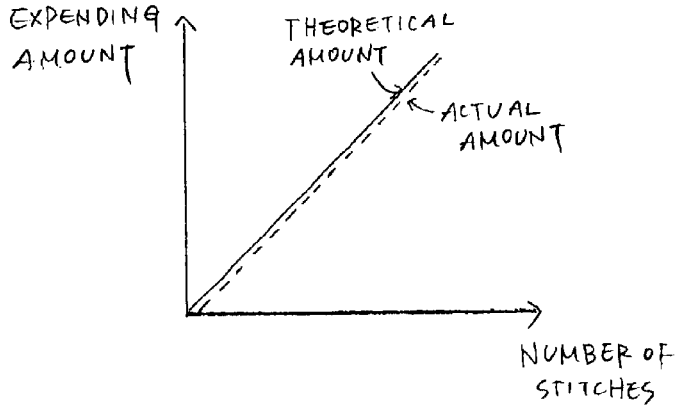
FIG. 10(*a*) is a graph showing an actual expending amount expended during ordinary operations.
Figure 10B:
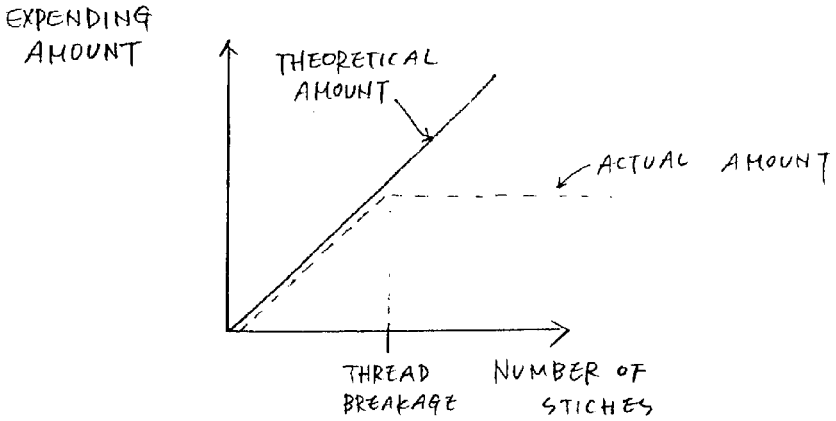
Figure 10C:
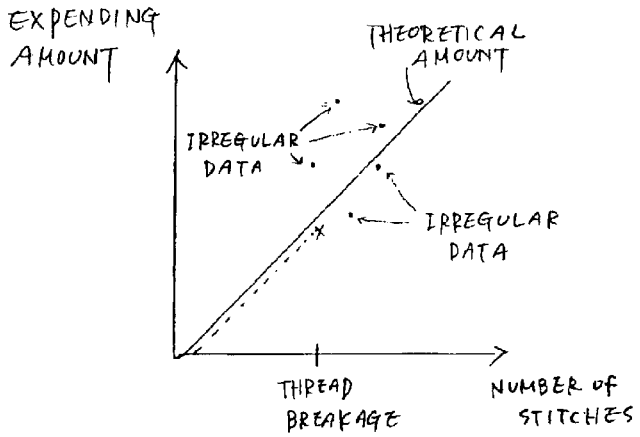

It should be noted that it is possible to detect, when a thread breakage occurs, whether the needle thread 14 was broken or the bobbin thread 60 was broken. Specifically, the expending amount of the needle thread 14 during ordinary embroidery operation can be calculated based on stitching data. During the ordinary operation, the actual expending amount of the needle thread 14, which is calculated based on the rotation of the rotary disk 17, matches the theoretical expending amount calculated based on the stitching data as shown in FIG. 10(*a*). However, when the needle thread 14 breaks, the actual expending amount stops increasing as shown in FIG. 10(*b*). On the other hand, when the bobbin thread 60 breaks, irregular data, which indicating the actual expending amount, appear in the data pattern as shown in FIG. 10(*c*). This is because the thread breakage of the bobbin thread 60 disrupts the stable rotation of the rotary disk 17, so that the rotary disk 17 rotates faster and slower than the regular speed to increase and decrease the needle-thread supply speed. Accordingly, when the irregular data appears, it is detected that the thread that was broken is the bobbin thread 60. Otherwise, it is detected that the thread that was broken is the needle thread 14.

While some exemplary embodiments of this invention have been described in detail, those skilled in the art will recognize that there are many possible modifications and variations which may be made in these exemplary-embodiments while yet retaining many of the novel features and advantages of the invention.

Figure 9A:
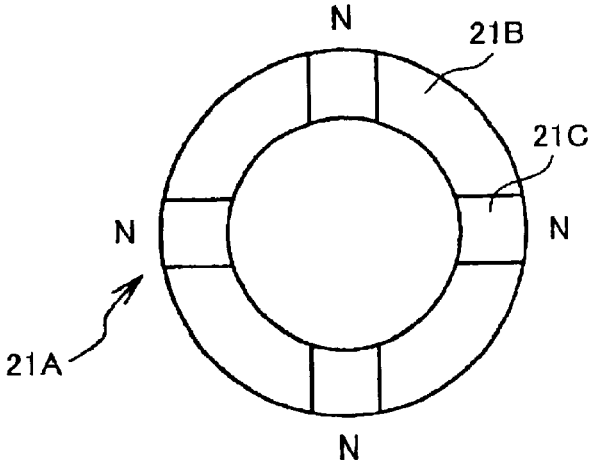
FIG. 9(*a*) is a front view of an alternative permanent magnet member.
Figure 9B:
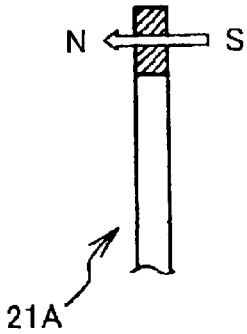

For example, as shown in FIGS. 9(*a*) and 9(*b*), a permanent magnet member 21A rather than the permanent magnet member 21 can be used. The permanent magnet member 21A includes a ring-shaped non-magnetic base 21B with one or more permanent magnet 21C. Also, the permanent magnet member 21 is not necessarily formed of a sintered metal, but could be formed of one or more permanent magnet.

Although the above embodiment is described for the multi-needle sewing machine 1 having the plurality of needles 15, the present invention can be applied to other type of sewing machines.

Moreover, although the broken-thread detecting unit 40 is provided to the tension unit 11 that applies a tension to the needle thread 14, the broken-thread detecting unit 40 could be provided to a tension unit (not shown) that applies a tension to a bobbin thread if a sewing machine includes such a tension unit.

What is claimed is:

1. A thread breakage detection device used in a stitch balancing thread tension having a shaft and a rotary disk having a surface extending perpendicular to an axial direction of the shaft and rotating in accordance with a supply of a thread, comprising:

a permanent magnet member attached to the surface of the rotary disk and generating a magnetic field;

a hole element that detects the magnetic field generated in the permanent magnet member and outputs a detection signal based on the detected magnetic field; and a detection unit that detects a thread breakage of the thread based on the detection signal, wherein the hole element is disposed on one side of the permanent magnet member and the rotary disk is disposed on an opposite side of the permanent magnet member.

2. The thread breakage detection device according to claim 1, wherein the permanent magnet member has a surface in which a plurality of north poles and a plurality of south poles are arranged in alternation to give the permanent magnet member a ring shape.

3. The thread breakage detection device according to claim 2, wherein the permanent magnet member is formed of a sintered metal.

4. The thread breakage detection device according to claim 2, wherein the hole element is located confronting the surface of the permanent magnet member.

5. The thread breakage detection device according to claim 1, wherein the permanent magnet member rotates along with the rotary disk, and the detection unit detects the thread breakage by detecting whether or not the rotary disk has stopped rotating during an embroidery operation based on the detection signal.

6. The thread breakage detection device according to claim 1, wherein the thread is a needle thread.

7. The thread breakage detection device according to claim 1, wherein the rotary disk is rotatable with respect to a stationary member of the stitch balancing thread tension, and a position of the stationary member is adjustable with respect to a frame of a sewing machine.

8. A stitch balancing thread tension comprising:

a stationary member;

a shaft relatively rotatable with respect to the stationary member;

a rotary disk that applies a tension to a thread, the rotary disk being mounted on the shaft and having a surface that extends perpendicular to an axial direction of the shaft;

a permanent magnet member attached to the surface of the rotary disk; and a hole element mounted on the stationary member, the hole element detecting a magnetic field generated in the permanent magnet member, wherein the hole element is disposed on one side of the permanent magnet member and the rotary disk is disposed on an opposite side of the permanent magnet member.

9. The stitch balancing thread tension according to claim 8, further comprising a detector that detects a thread breakage of the thread, wherein the hole element outputs a detection signal based on the detected magnetic field, and the detection unit detects the thread breakage based on the detection signal.

10. The stitch balancing thread tension according to claim 8, wherein the permanent magnet member has a surface in which a plurality of north poles and a plurality of south poles are arranged in alternation to give the permanent magnet member a ring shape.

11. The stitch balancing thread tension according to claim 8, wherein the permanent magnet member is formed of a sintered metal.

12. The stitch balancing thread tension according to claim 8, wherein the thread is a needle thread.

13. The stitch balancing thread tension according to claim 8, wherein the rotary disk is rotatable relative to the stationary member, and a position of the stationary member is adjustable with respect to a frame of a sewing machine.

14. A sewing machine comprising;

a stationary member;

a shaft relatively rotatable with respect to the stationary member;

a rotary disk that applies a tension to a thread, the rotary disk being mounted on the shaft and having a surface that extends perpendicular to an axial direction of the shaft;

a permanent magnet member attached to the surface of the rotary disk;

a hole element mounted on the stationary member, the hole element detecting a magnetic field generated in the permanent magnet member and outputting a detection signal based on the detected magnetic field;

a measuring unit that measures a time duration during an embroidery operation;

a counting unit that counts a number of times the detection signal changes during the embroidery operation; and a detector that detects a thread breakage of the thread when the counting unit does not count a predetermined number within a predetermined time duration during the embroidery operation, wherein the hole element is disposed on one side of the permanent magnet member and the rotary disk is disposed on an opposite side of the permanent magnet member.

15. The sewing machine according to claim 14, wherein the permanent magnet member has a surface in which a plurality of north poles and a plurality of south poles are arranged in alternation to give the permanent magnet member a ring shape.

16. The sewing machine according to claim 14 further comprising a frame, wherein the stationary member is relatively movably attached to the frame.

17. The sewing machine according to claim 14, wherein the thread is a needle thread.

* * * * *